US006827618B1

(12) United States Patent
Hampton et al.

(10) Patent No.: US 6,827,618 B1
(45) Date of Patent: Dec. 7, 2004

(54) SAFETY BOOM

(75) Inventors: Holly Hampton, Toronto (CA); James Jordan, Toronto (CA)

(73) Assignee: SNC Lavalin Engineers & Constructors Inc., Ontario (CA)

( * ) Notice: Subject to any disclaimer, the term of this patent is extended or adjusted under 35 U.S.C. 154(b) by 0 days.

(21) Appl. No.: 10/602,659

(22) Filed: Jun. 25, 2003

(51) Int. Cl.[7] ..... B63C 9/00
(52) U.S. Cl. ..... 441/80; 405/63
(58) Field of Search ..... 441/80, 84, 133, 441/134; 405/63–71

(56) References Cited

U.S. PATENT DOCUMENTS 1,179,583 A * 4/1916 Ward ..... 441/80

* cited by examiner

*Primary Examiner*—Ed Swinehart
(74) *Attorney, Agent, or Firm*—Ogilvy Renault; Paul J. Field

(57) ABSTRACT

A buoyant boom having: an elongate band extending across a water surface; floats rotatably mounted to the band with rotary bearings between each float and the band; and anchors securing the band at its ends or middle portion to a support, such as a river bed or a river bank structure for example.

21 Claims, 15 Drawing Sheets

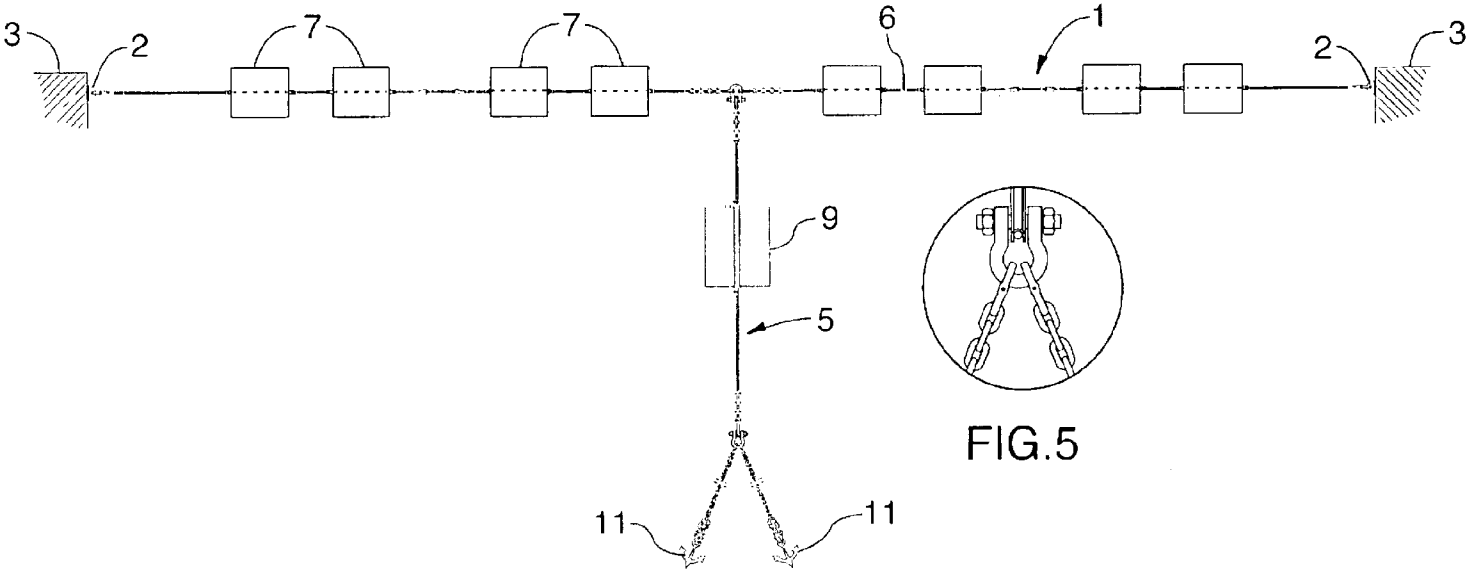
FIG.5
FIG.4
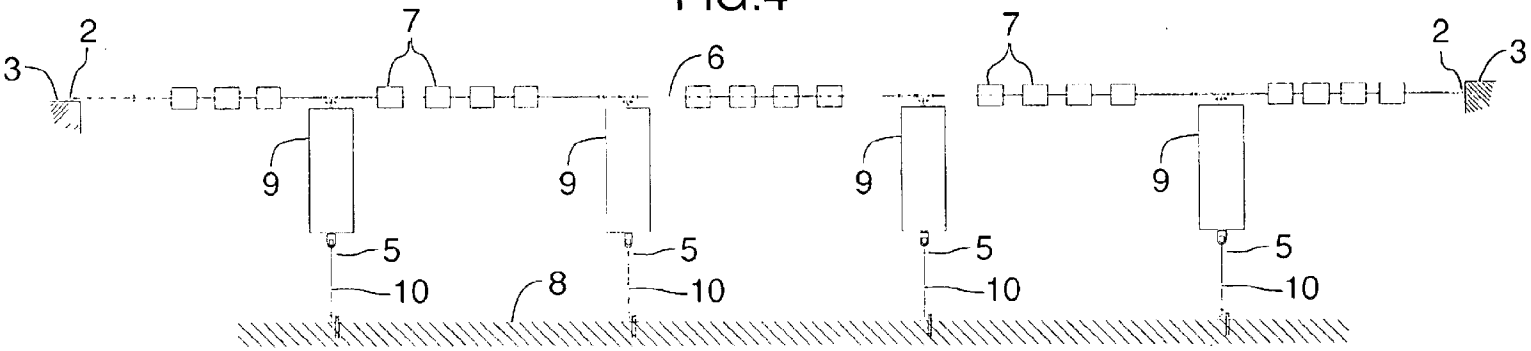
FIG.6

SAFETY BOOM

TECHNICAL FIELD

The invention relates to a buoyant safety boom to provide a physical barrier and visual warning to swimmers and boaters to avoid water hazards, such as dams, gates, locks, intake pipes, rapids and the like.

BACKGROUND OF THE ART

Buoyant booms comprising a band of rope or chain with floats spaced along the length of the flexible band, are used as a physical barrier and visual warning on water surfaces for example to warn swimmers and boaters to avoid water hazards, to divide swimming areas into deep water and shallow water for the protection of children and as well can be used for containment systems such as to collect surface oil during an environmental accident, to provide a shark barrier or divide a fish farm or oyster farm area where the boom suspends a fence or net downwardly from the water surface.

In the example provided in the present application, the boom provides a buoyant safety barrier to prevent swimmers or boaters from approaching within a hazardous distance to a dam or gate across a river. The booms are designed to remain in service year round and will not be damaged due to cold climates, ice flows, or floating debris. The booms are designed to permit ice flows and floating debris to pass under the booms.

Particularly in fast moving rivers however the floats of a boom are often drawn under the water surface by the current flows created by the water flow past the floats. Since the boom function is to provide a visual warning and a physical barrier, obviously drawing the boom under the water surface defeats this purpose.

It is an object of the present invention to provide a buoyant boom with rotary mounted floats which can be subjected to high rates of surface water flow while maintaining a high free board as a visual warning and physical barrier.

Further objects of the invention will be apparent from review of the disclosure, drawings and description of the invention below.

DISCLOSURE OF THE INVENTION

The invention provides a buoyant boom having: an elongate band extending across a water surface; floats rotatably mounted to the band with rotary bearings between each float and the band; and anchors securing the band at its ends or middle portion to a support, such as a river bed or a river bank structure for example.

DESCRIPTION OF THE DRAWINGS

In order that the invention may be readily understood, embodiments of the invention are illustrated by way of example in the accompanying drawings.

FIGS. 4 and 5 illustrate another example of a simple boom including a single intermediate anchor embedded to the river bed with ships anchors.

FIG. 6 shows a further example of a boom including five intermediate anchors, each with an anchor float.

Further details of the invention and its advantages will be apparent from the detailed description included below.

DETAILED DESCRIPTION OF PREFERRED EMBODIMENTS

Figure 1:
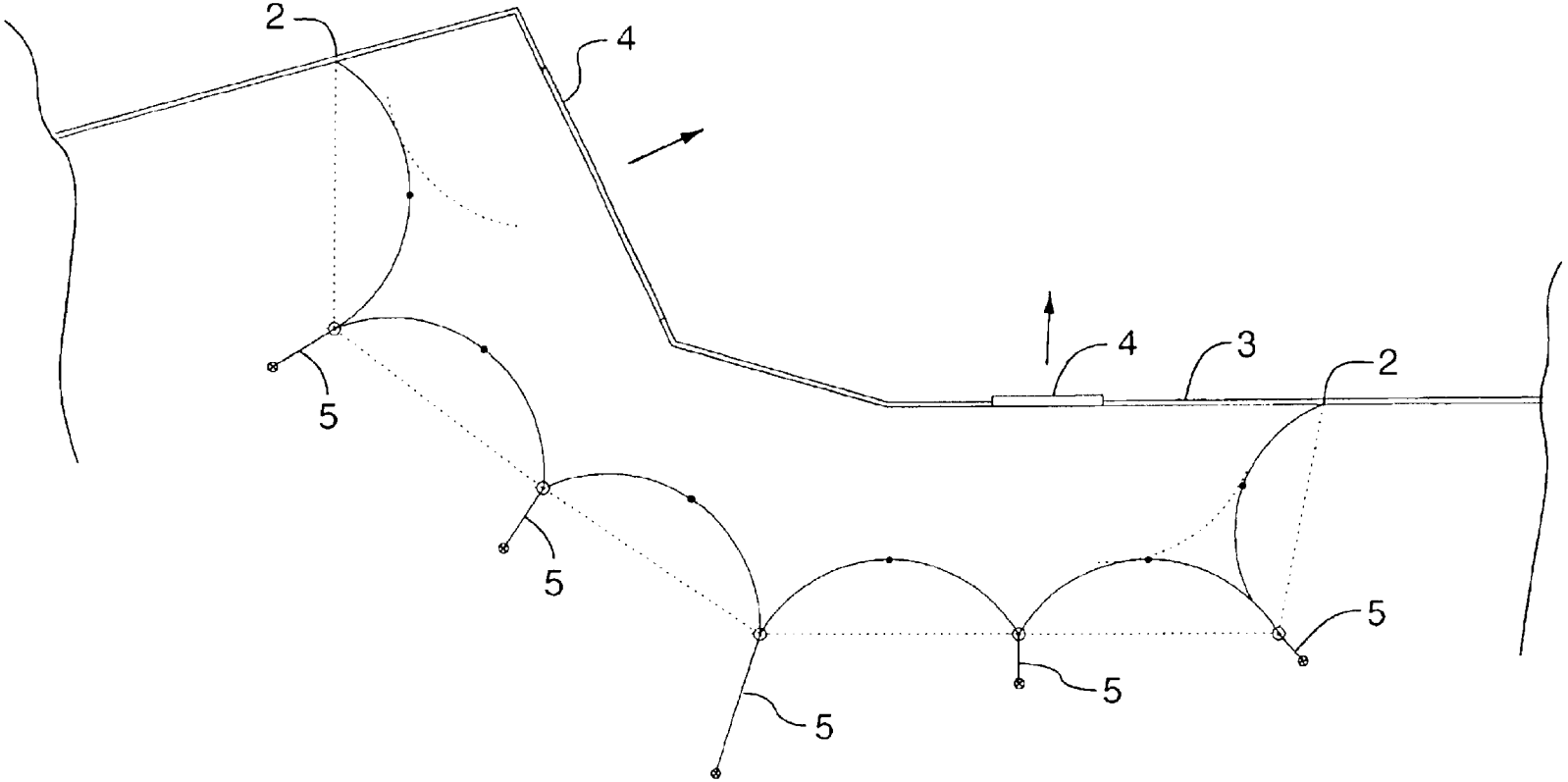
FIG. 1 is a plan view showing an example of the dam across a river with a buoyant safety boom deployed upstream from the dam, the boom including a series of anchors between which the boom extends in an arcuate path created by the river flow.

FIG. 1 shows a plan view of a six span buoyant boom 1 extending between end anchors 2 secured to a concrete wall.

The wall comprises part of a dam 3 extending across the river and includes two gates 4 which confine the flow of water, as indicated with arrows, flowing in a direction downstream from the boom 1. In the embodiment illustrated, the boom 1 includes five intermediate anchors 5 secured to the bedrock in the river bed in the manner described below. Between the intermediate anchors 5 the elongate flexible band of the boom 1 forms a concatenary curve as a result of the downstream flow of water impinging on the floats of the boom.

Although the example shown in the present application relates to a safety boom across a river, it will be understood that the invention is also applicable to many other situations such as oil containment or suspended barrier applications.

Figure 2:
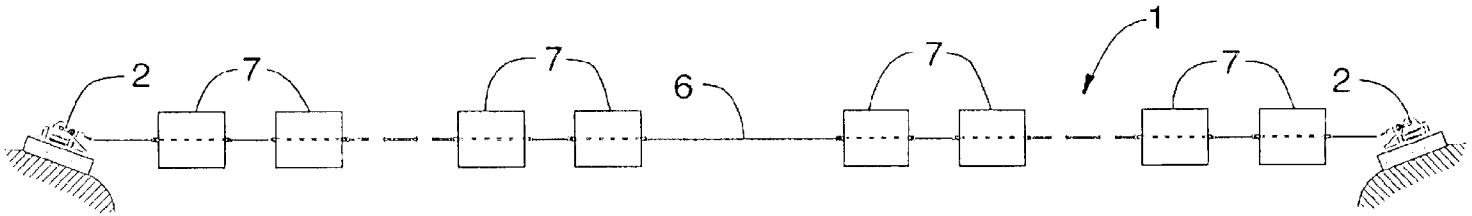
FIG. 2 shows an example of a simple boom extending between two end anchors mounted to a river bank supporting surface and including a number of floats spaced apart along the length of the boom.

FIG. 2 shows a simple example of a boom 1 with a band 6 extending across a water surface and secured with end anchors 2. A number of floats 7 are rotatably mounted to the elongate band 6. Rotary bearing described in detail below are disposed between the floats 7 and the band 6 to prevent the floats 7 from being drawn downwardly under forces created by the flow of current past the floats 7. In general, the anchors 2 have an upper end secured to the band 6 and the lower end anchor 2 to a supporting surface such as the river bank or river bed or in some cases a concrete wall structure of the dam.

Figure 3:
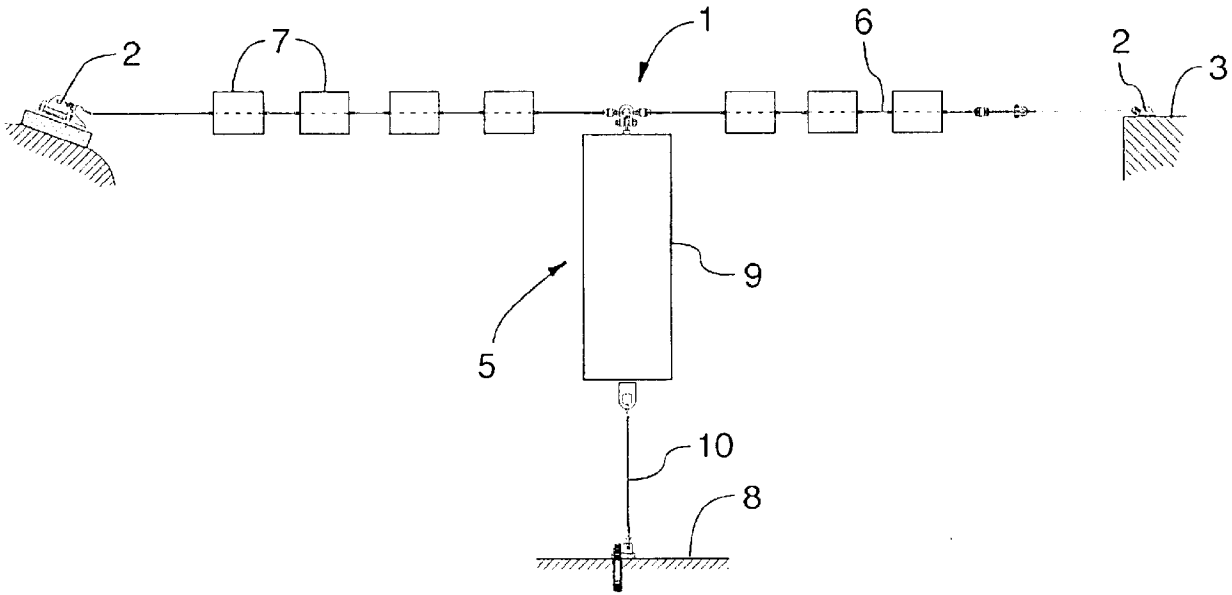
FIG. 3 shows another example of a simple boom extending between an end anchor at the left secured to a river bank and a concrete wall surface at the right and including a single intermediate anchor with anchor float secured to the river bed.

FIG. 3 shows another embodiment of the boom 1 which includes an intermediate anchor 5 to secure a middle portion of the band 6 to the supporting river bed. In the embodiment shown, the intermediate anchor 5 includes an anchor float 9 to counteract the downward force component of the tension in the intermediate anchor 5 created by the flow of water. The intermediate anchor 5 also includes a wire rope 10 which is anchored to the river bed 8 in a manner described below.

FIGS. 4 and 5 show a further embodiment of a boom 1 with floats 7 rotatably mounted on the band 6 with a single intermediate anchor 5 with anchor float 9 secured to the river bed 8 with ship anchors 11 and chains.

FIG. 6 shows a further example with five intermediate anchors 5 and anchor floats 9 each secured to the river bed 8 with wire rope cables 10 embedded with grouted bolts.

Figure 7:
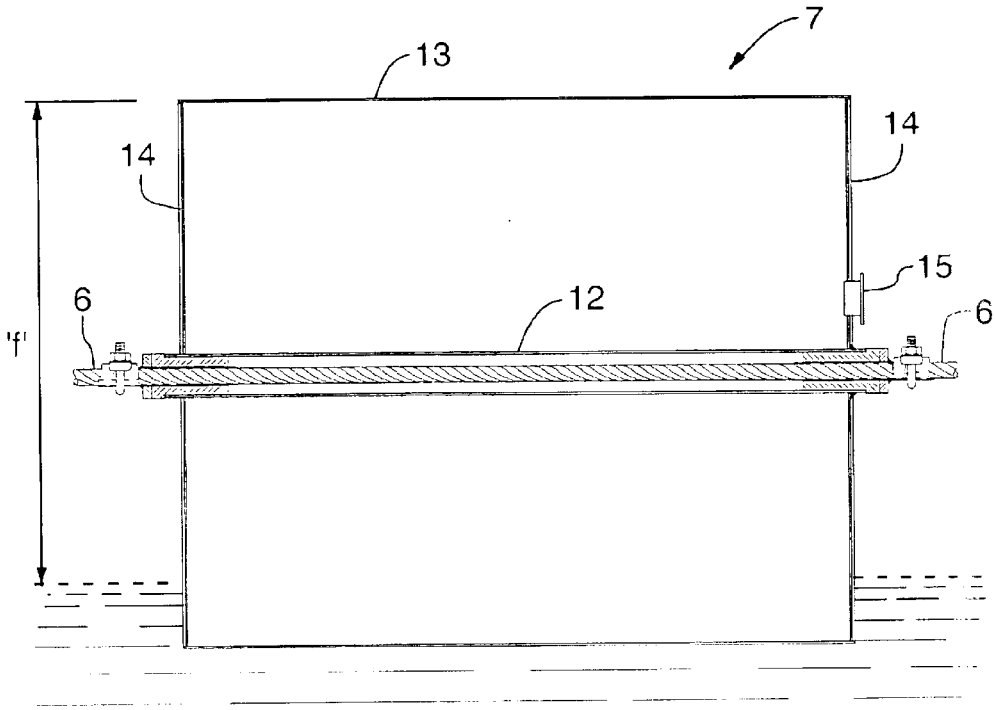
FIGS. 7 and 8 show details of each individual float which in the embodiment illustrated comprise a metal cylinder with central tube through which the band of the boom extends and including a plug through polyurethane foam is injected to fill the shell of the float.
Figure 8:
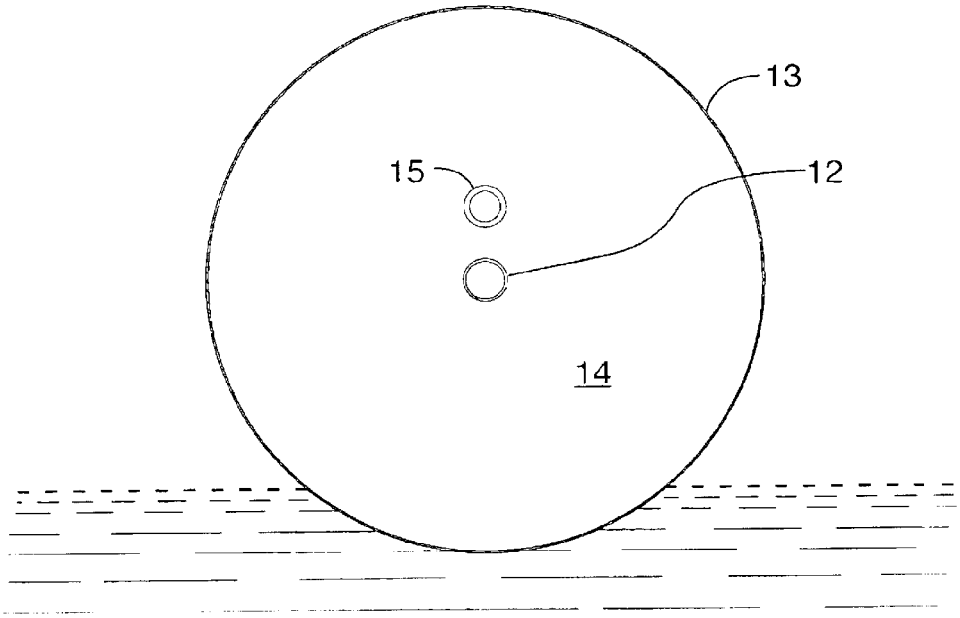
Figure 9:
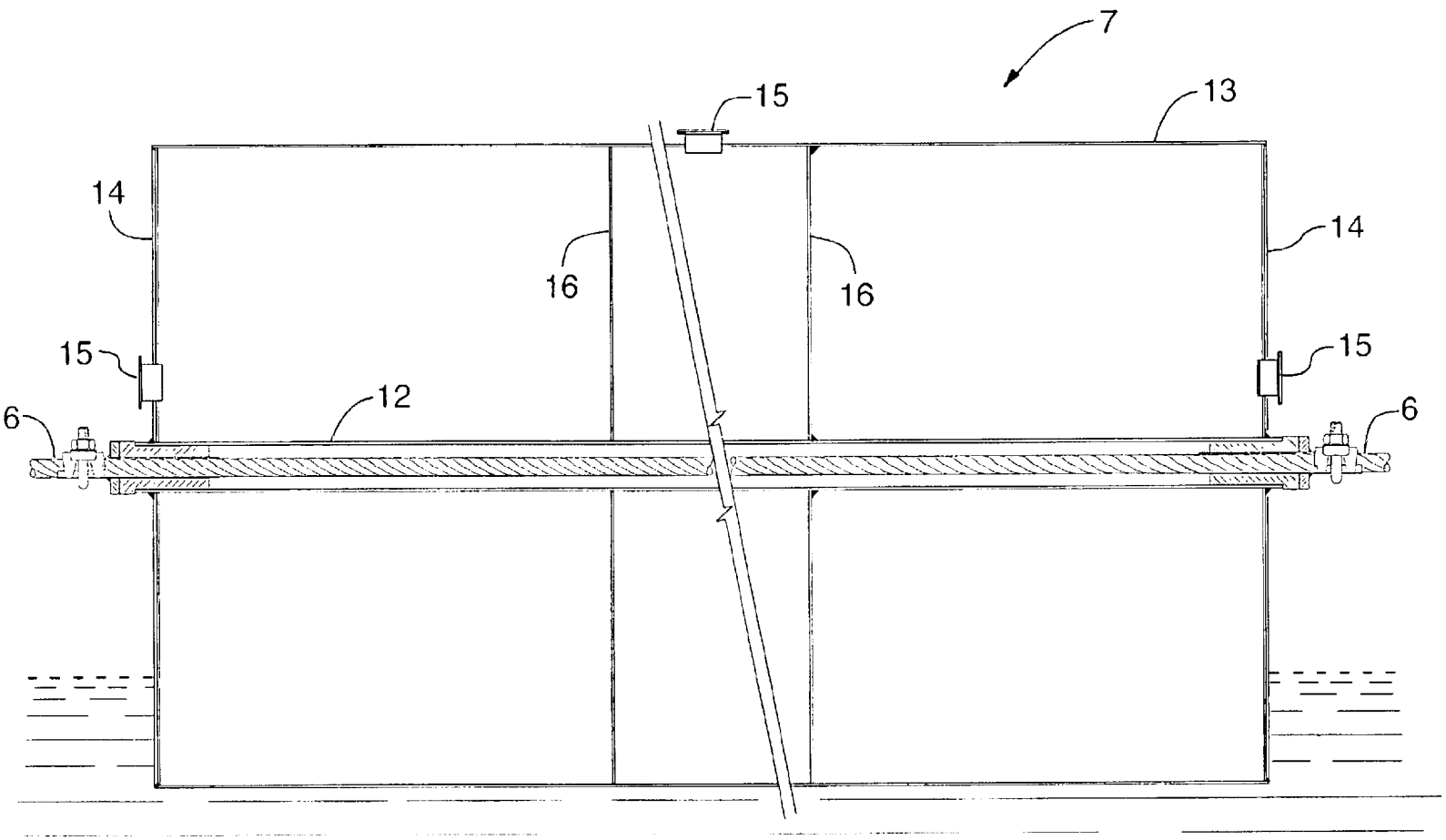
FIG. 9 shows another embodiment of the float including a central tube and cylindrical metal shell however further including interior dividing plates which divide the float into three separate chambers which are individually filled with polyurethane foam.

FIGS. 7, 8 and 9 show the details of construction of the floats 7 which preferably include a central elongate tube 12 through which the band 6 extends. In the embodiment shown the band 6 comprises a metal wire rope which provides an easily constructed and economical corrosion resistant band 6. Each float 7 includes a cylindrical outer shell 13 with round end wall 14 having a central opening through which the tube 12 and band 6 extend. The floats 7 include a plug 15 which can be removed for filling with a buoyant foam preferably a closed cell expanding polyurethane foam having a density no greater than 2.5 $lb/ft^3$ and preferably no greater than 2 $lb/ft^3$. The alternative float of FIG. 9 includes an optional pair of reinforcing plates 16 extending between the cylindrical shell 13 and the central tube 12 to reinforce the longer floats 7 and create three separate chambers which are accessible for insertion of polyurethane foam through three plugs 15 as illustrated.

In the embodiment shown in FIGS. 7, 8 and 9 the free board dimension "f" is relatively large to present a large visual barrier and further to maintain the tube 12 with bearings substantially out of the water for inspection and maintenance. Of course the free board dimension "f" may be selected by the designer by selecting different dimensions for the float depending on the forces involved.

Figure 12:
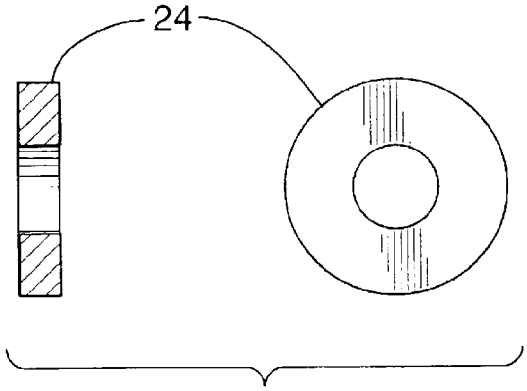
FIG. 12 shows details of a radially extending collar which mounts to the sleeve of FIG. 11.
Figure 13:
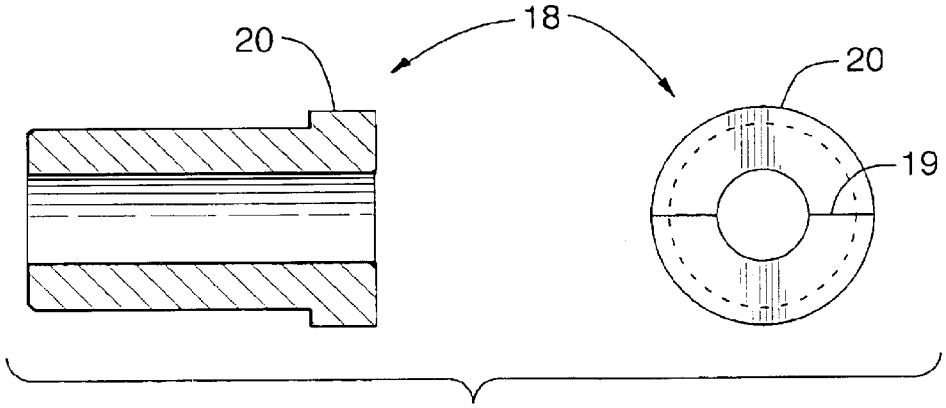
FIG. 13 shows detailed drawing of the polyethylene split bushing which serves as a friction resisting component in the bearing.

Referring to FIGS. 10, 11, 12 and 13, the details of the rotary bearings will be discussed. As shown in FIG. 12, the elongate tube 12 which is disposed about the band 6 provides a convenient means to contain and install bearings 17 at both ends of the tube 12 as the band passes through the end wall 14 of the float 7. The bearings 17 include an annular bushing 18 which as shown in FIG. 13 is preferably split longitudinally along joint 19 for easy installation and replacement. The bushing 18 also includes a radially projecting flange 20 to resist longitudinal forces as a thrust bearing. The bushing 18 preferably comprises UHNW polyethylene and is the replaceable or sacrificial portion of the bearing 17 which serves to reduce friction between the inside surface of the tube 12 and the outside surface of an elongate sleeve 21 that is disposed between the band 6 and the bushing 18.

Figure 10:
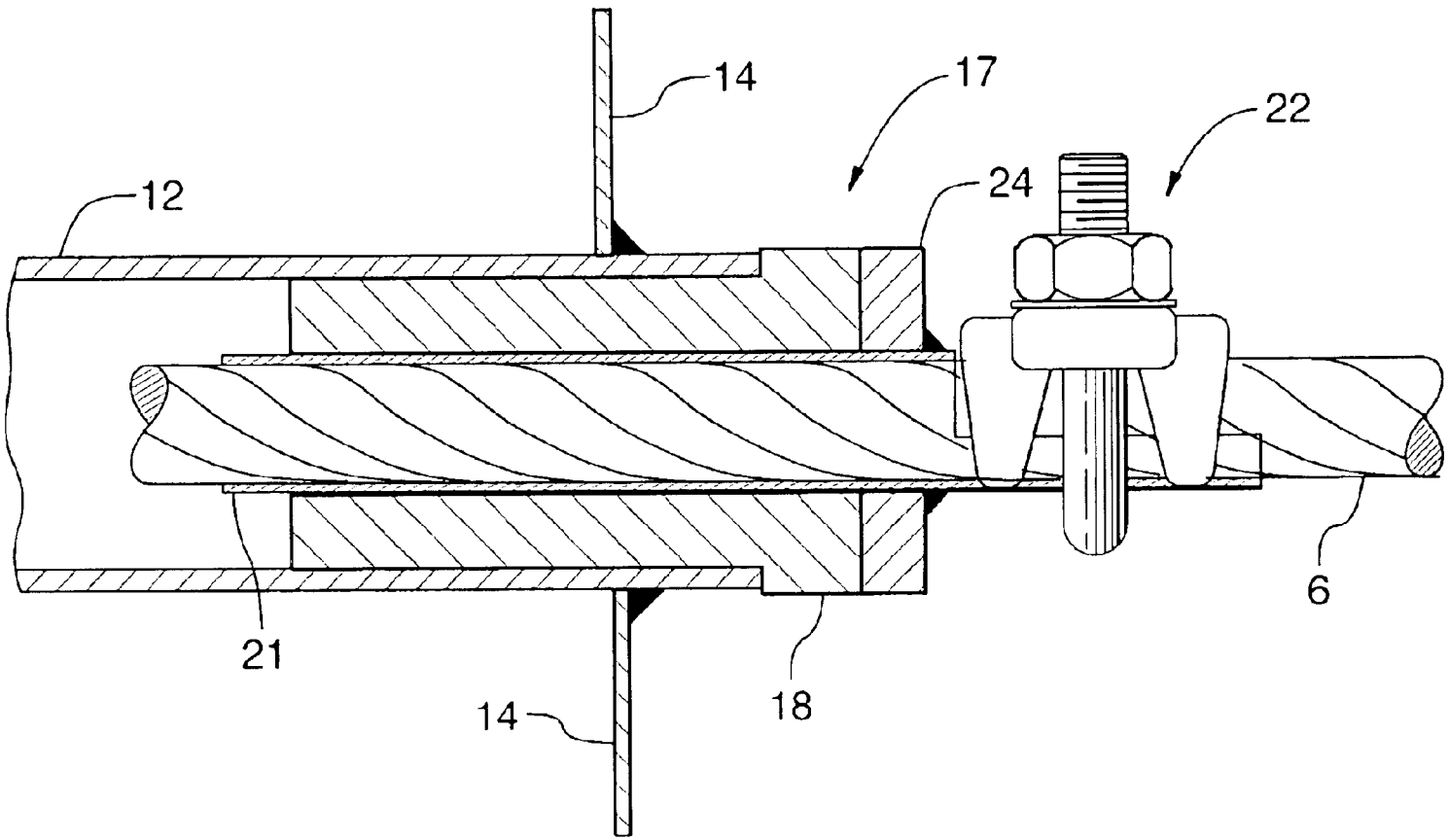
FIG. 10 shows a detail of a bearing assembly between each end of each float and the supporting wire rope type band secured with a U-shaped Crosby clip.
Figure 11:
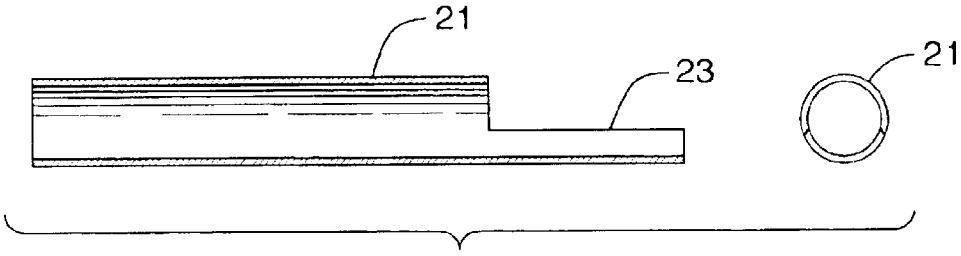
FIG. 11 shows details of a protective sleeve about the band, which forms part of the rotary bearing of FIG. 10.

The elongate sleeve 21 serves as protection for the band 6 and a clamp 22 secures the sleeve 21 to the band 6 to prevent relative rotary and longitudinal movement between the sleeve 21 and the band 6. The sleeve 21 includes a notched outer end 23 that enables the clamp 22 to securely engage the band 6 and the sleeve 22. To resist longitudinally movement the sleeve 21 includes a radially extending collar 24 which is welded to the sleeve 21 as shown in FIG. 10 and abuts the outer end of the bushing flange 20 to serve as a thrust bearing.

Figure 20:
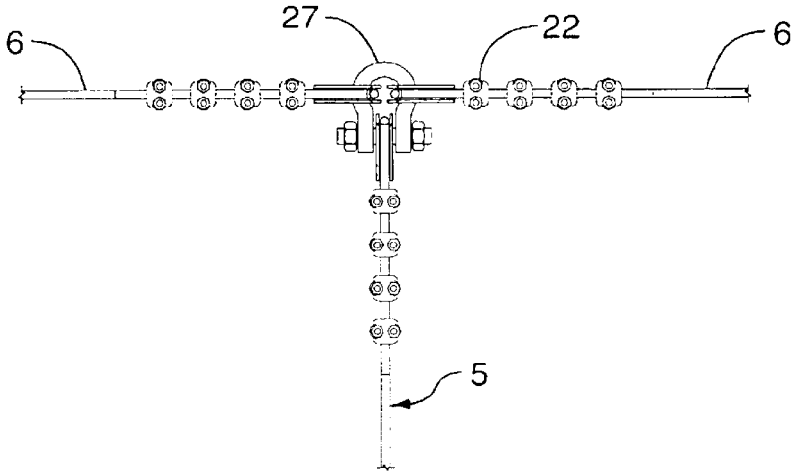
FIGS. 20, 21 and 22 show typical connection details between an intermediate anchor and the band, the splice connection and a weak link respectively.
Figure 21:
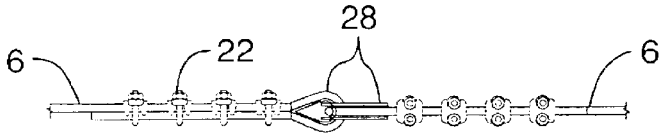
Figure 22:
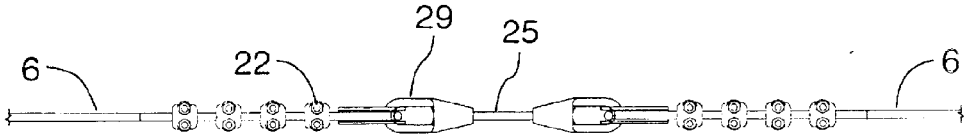
Figure 23:
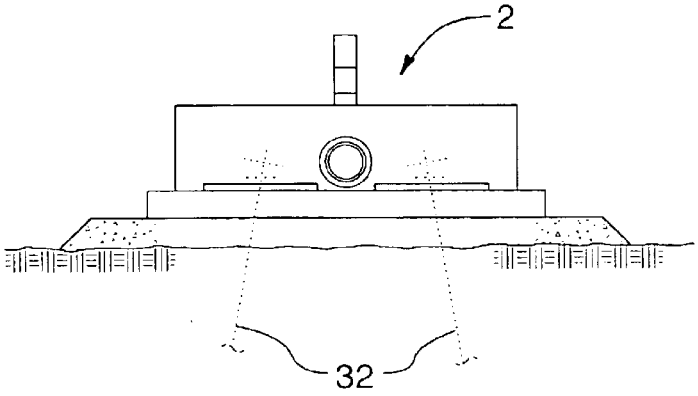
FIGS. 23, 24 and 25 show elevation and plan views of an end anchor used to secure an end of the boom to a river band surface for example.
Figure 24:
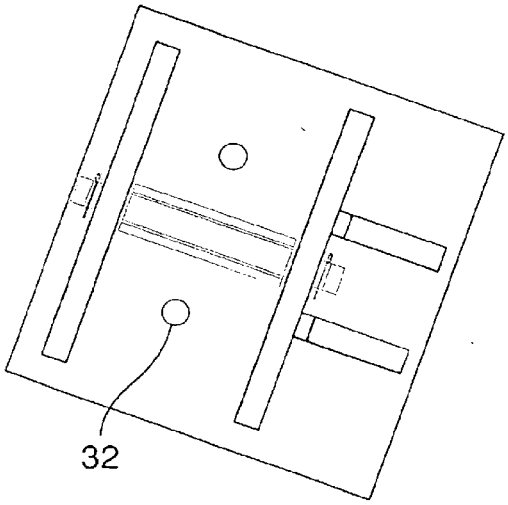
Figure 25:
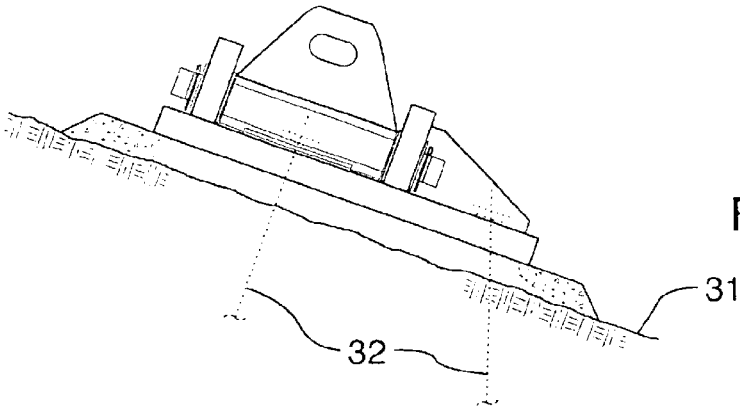
Figure 26:
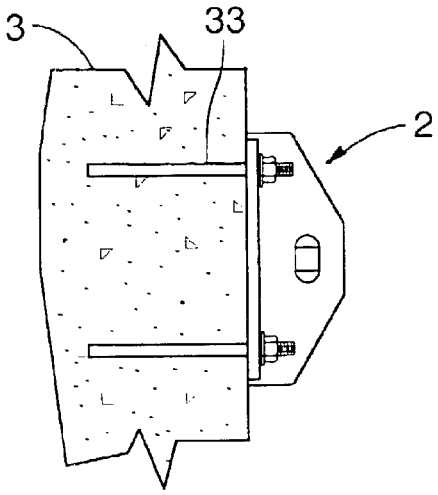
FIGS. 26, 27 and 28 show plan and elevation views of an end anchor for securing an end of the boom to an adjacent concrete wall.
Figure 27:
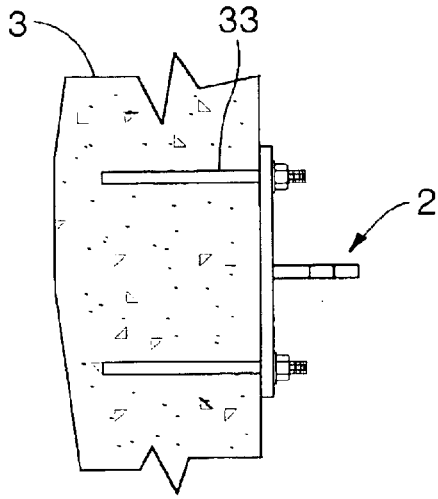
Figure 28:
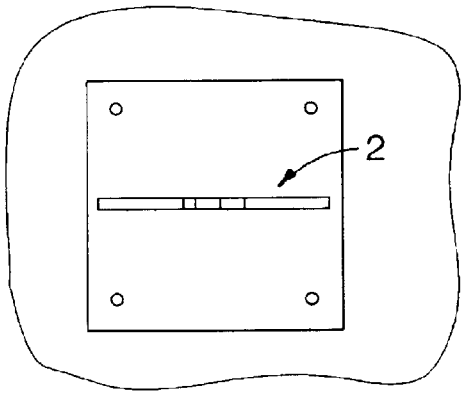
Figure 29:
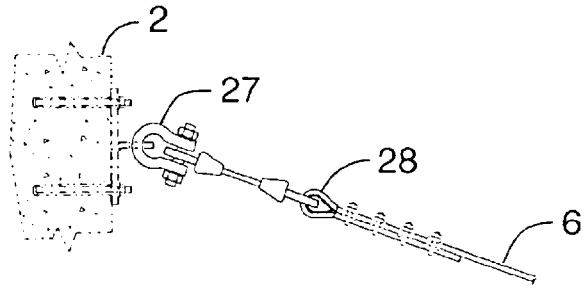
FIGS. 29, 30 and 31 show details of the connection between the boom and the end anchors shown in the previous Figures.
Figure 30:
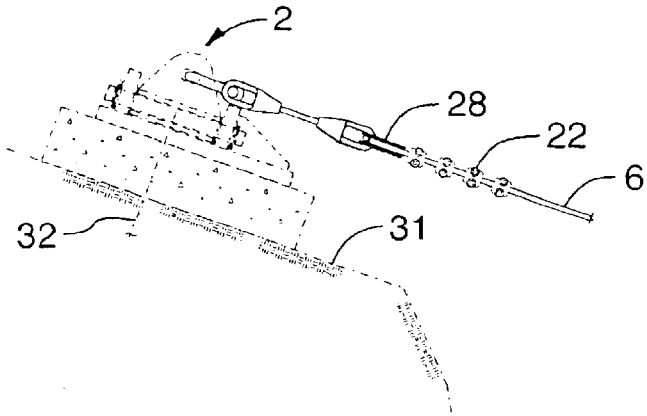
Figure 31:
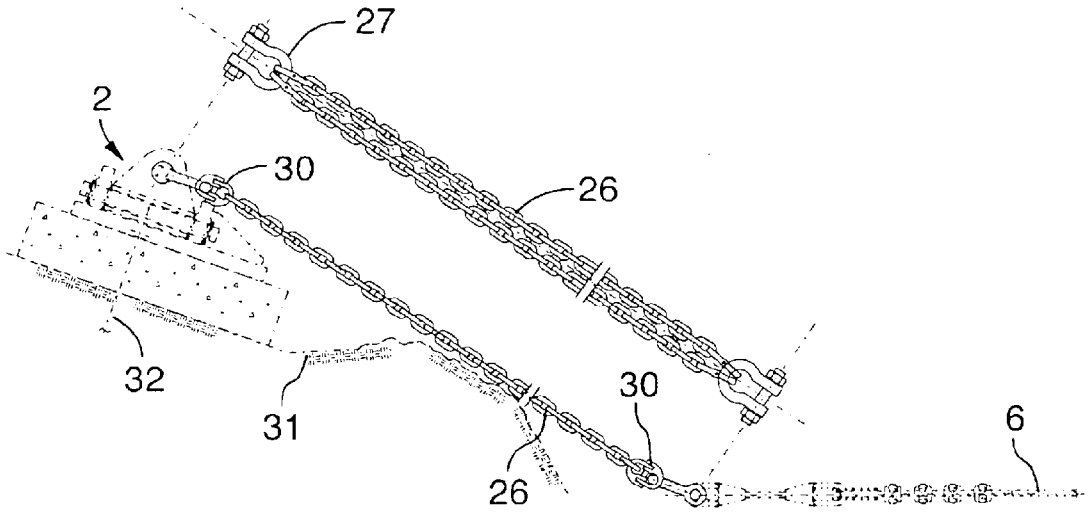

With reference to FIGS. 20, 21, 22 as well as 29 through 31, it will be understood that although the illustrations primarily show the band 6 as a metal wire rope. The band 6 can also include metal chains 26, metal bar stock, a safety link 25 having a tensile capacity less than that of the remainder of the band 6, shackles 27, wire rope thimbles 28, clamps 22, a spelter socket 29, chain linkage 30 as well as in relatively light duty applications, the possibility of twisted fiber rope or braided rope. The safety link 25 will fail before the remainder of the band when excessive catastrophic forces are encountered such as during an unpredicted ice flow, boat impact, or debris impact. The safety link 25 enables only the section that has been engaged to fail rather than commencing a progressive or chain reaction failure of the entire boom and anchors.

FIGS. 23 through 31 show the details of end anchors 22 which secure an outer end of the band 6 to a support such as the river bank 31 with anchor bolts 32 or to a concrete wall of the dam 3 with grouted metal rods 33.

Figure 14:
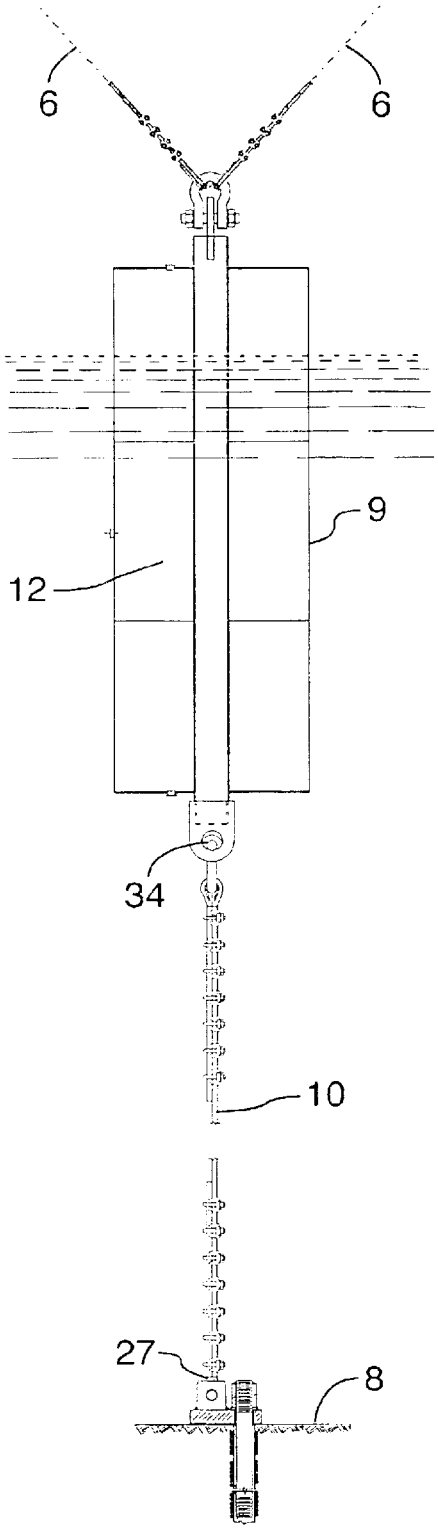
FIG. 14 shows details of the construction of an intermediate anchor including an anchor float and wire rope cable securing the anchor to the river bed.
Figure 19:
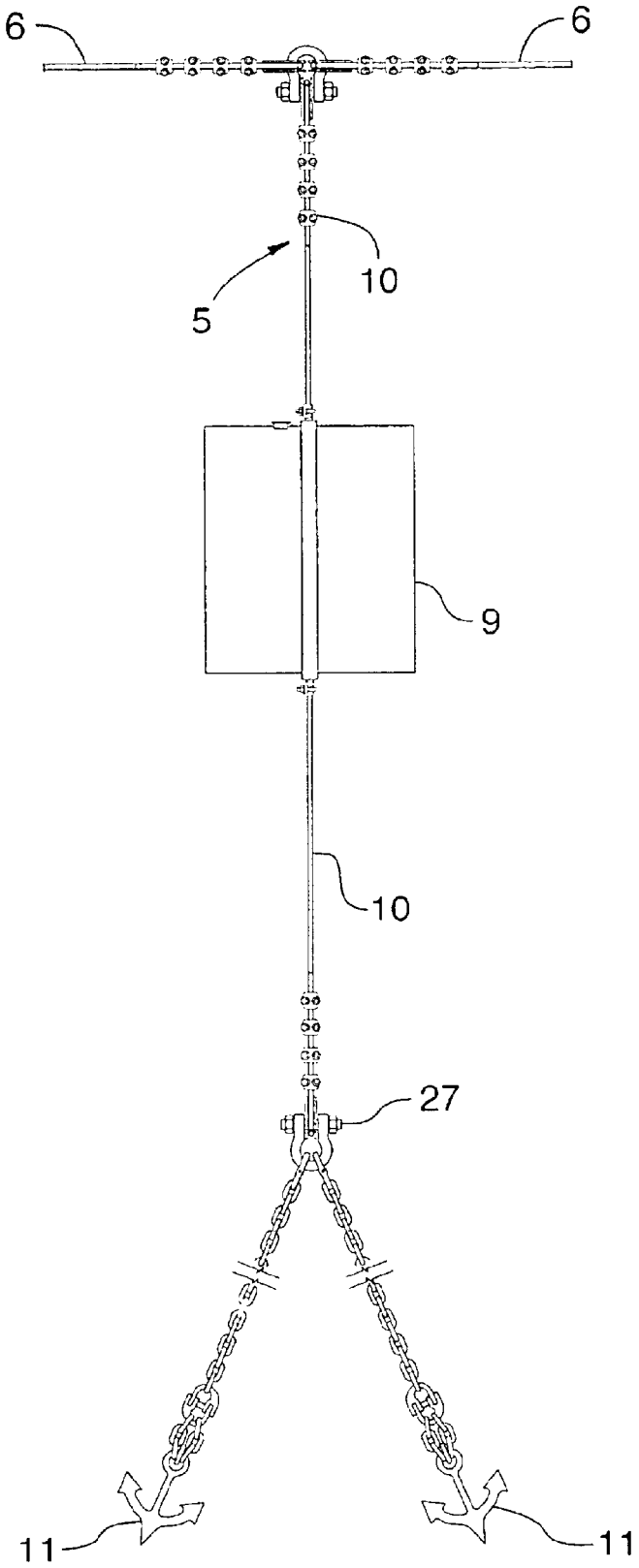
FIG. 19 shows an alternative embodiment of an intermediate anchor.

FIGS. 14 and 19 show two embodiments of intermediate anchors 5 which secure a middle portion of the band 6 to the supporting river bed B. In each case, the intermediate anchor 5 includes an anchor float 9. In the embodiment of FIG. 19, ships anchors 11 are used to secure the wire rope 10 to the river bed B. A relatively simple anchor float 9 of the type shown in FIGS. 7 and 8 is used.

Figure 15:
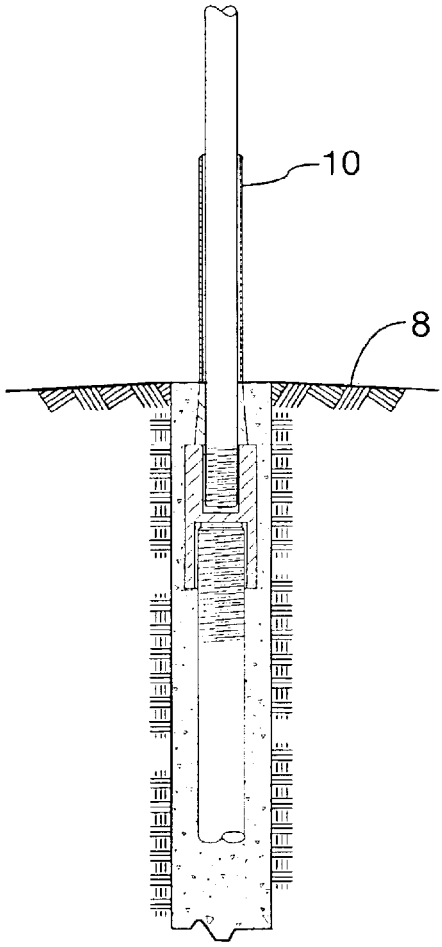
FIG. 15 shows the location of a preferred anchor with metal rod embedded in the grouted hole drilled into the bedrock beneath the river bed.

FIG. 14 shows a relatively robust anchor float 9 which has a central tube 12 with end plates 34 to secure the wire rope 10. The anchoring of the wire rope 10 to the river bed 8 as shown in FIG. 14 can be used in relatively shallow water where divers can safely operate to connect an end shackle 27. However FIGS. 15 and 16 illustrate a preferred method of connecting the cable wire rope 10 to the river bed 8 in very deep or fast moving water that is unsafe for divers or where cost and time involved would be excessive.

Figure 16:
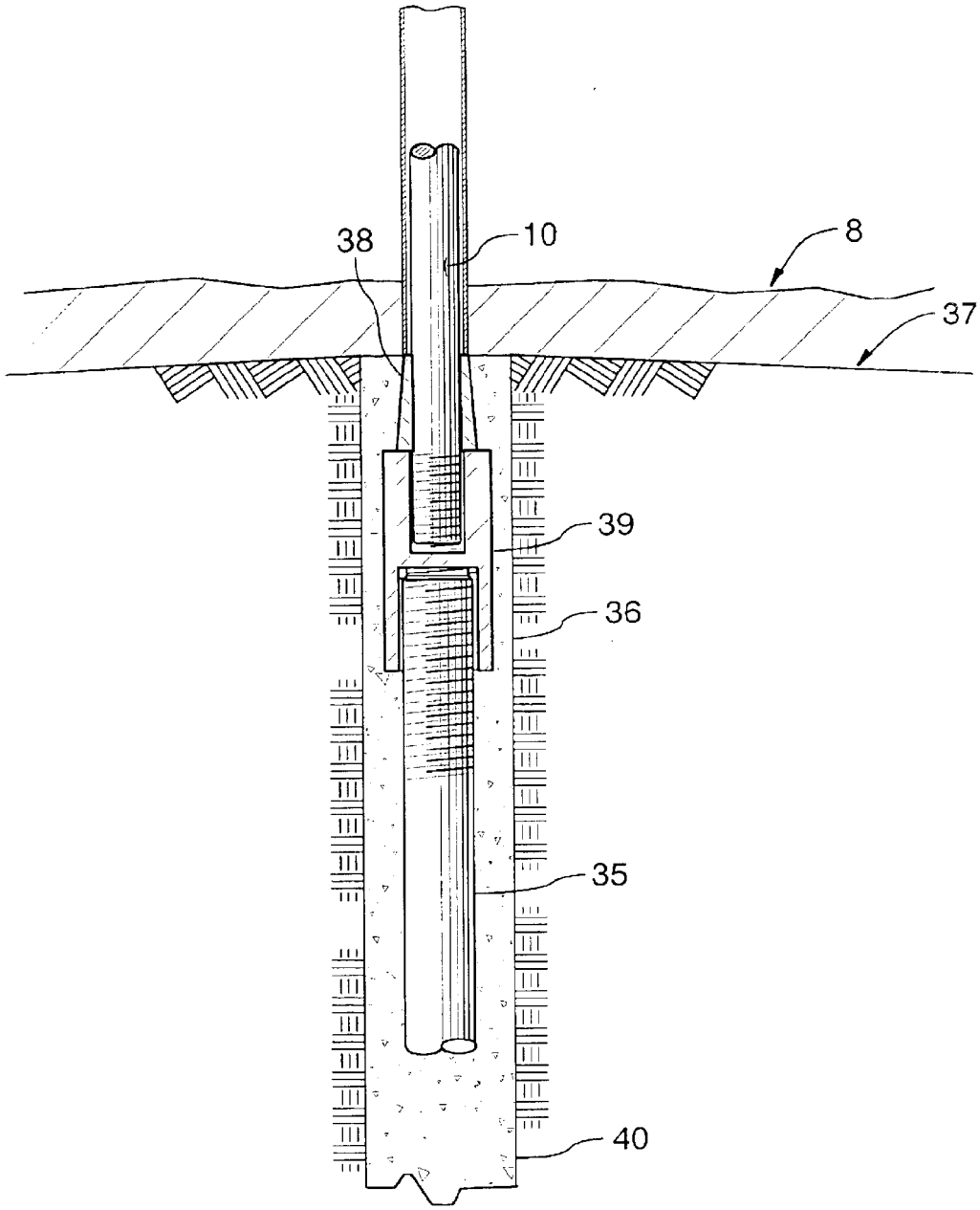
FIG. 16 shows a detailed view of the embedded metal rod and connectors as indicated in FIG. 16.

With reference to FIG. 16, the intermediate anchor 5 includes a metal rod 35 embedded in a grouted hole 36 grilled into the bedrock support 37 of the river bed 8. As shown in FIG. 16 the wire rope 10 is fitted at is end with a swaged threaded connector 38. The metal rod 35 also has an outer externally threaded end and the swaged externally threaded connector 38 is connected with a specially designed splice connector 39 with matching internal threads. The advantage of this assembly is that the cable 10, swaged threaded connector 38, splice connector 39 and metal rod 35 can be assembled together (and if necessary tested for tensile capacity) on dry land. The hole 36 can be drilled from the water surface from a barge for example and filled with grout 40. The assembly is then lowered and positioned into the grouted hole 36 without requiring divers to descend to the river bottom in deep water.

Figure 17:
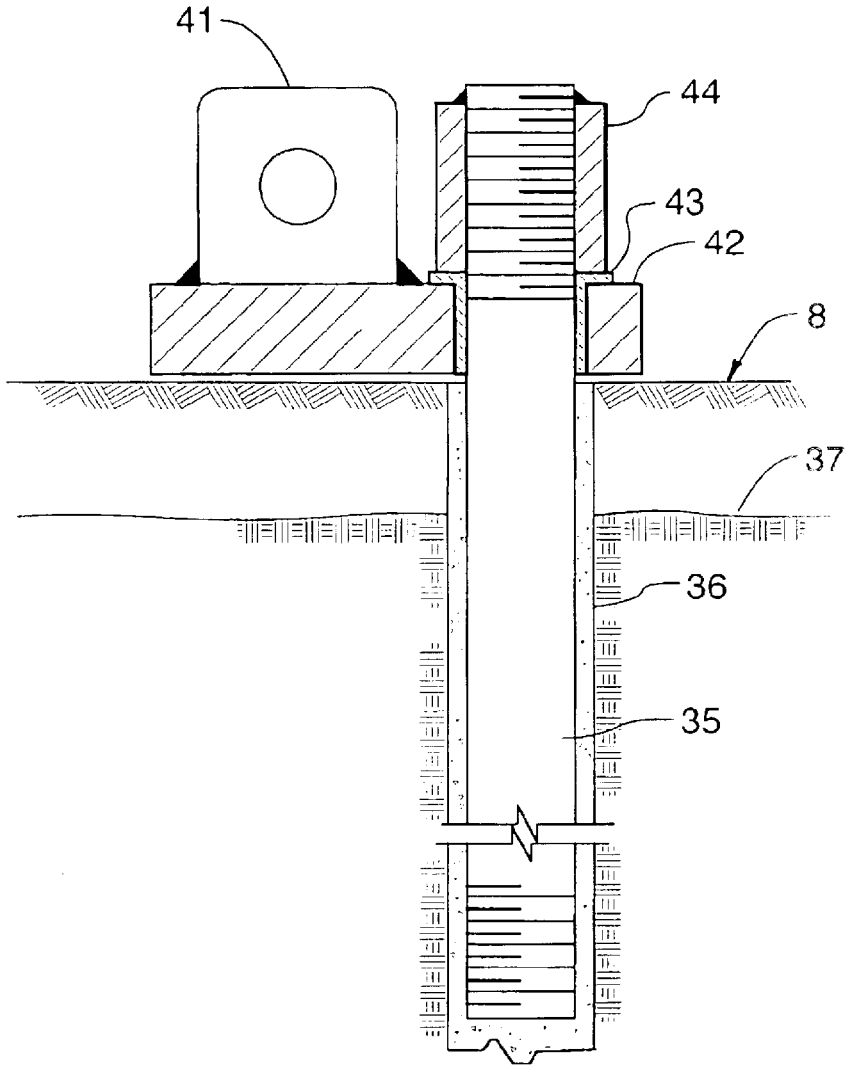
FIG. 17 shows an alternative embedded rod in a grouted hole with a rotatable mounted base plate for connecting an anchor to the river bed.
Figure 18:
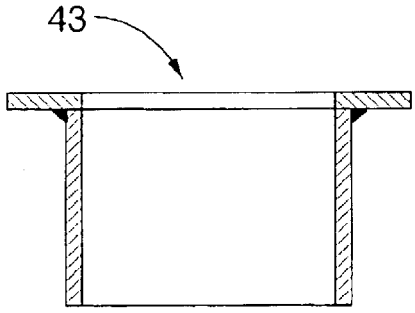
FIG. 18 shows details of a sleeve mounted between the embedded metal rod and base plate of FIG. 17.

An alternative anchor is shown in FIGS. 16 and 18 where divers can be used to connect a shackle to the lug 41 mounted to the base plate 42. Again, in the embodiment shown in FIG. 17 however the divers need not spend more time in the water than it is required to connect the shackle to the lug 41. The assembly of the threaded metal rod 35, the rotatably mounted base plate 42 with sleeve 43 and end nut 44 can be carried out on dry land. The grouted hole 36 can be drilled from a barge on the water surface and the assembly lowered into the grouted hole 36 from above. In the embodiment shown in FIGS. 17 and 18, the advantage of this arrangement is that the base plate 42 is rotatably mounted to the outer end of the metal rod 35 to accommodate placement of the intermediate anchors 5 and any relative rotary movement due to construction or changes in water level or flow direction. The anchors shown in FIG. 16 is suitable for deep water where relative bending between the cable 10 and the bed rock 37 is not expected.

Although the above description relates to a specific preferred embodiment as presently contemplated by the inventors, it will be understood that the invention in its broad aspect includes mechanical and functional equivalents of the elements described herein.

We claim:

1. A buoyant boom comprising:

an elongate band extending across a water surface;

a plurality of floats having a central axis, each float being radially symmetric about the central axis, the band having a portion engaging each float substantially aligned with said axis wherein each float is rotatably mounted to rotate about the band;

a plurality of rotary bearings disposed between the floats and the band; and a plurality of anchors having a first end secured to the band and a second end anchored to a support.

2. A buoyant boom according to claim 1 wherein the bearings comprise an annular bushing.

3. A buoyant boom according to claim 2 wherein the bushing includes a radially projecting flange on an outer end thereof.

4. A buoyant boom according to claim 2 wherein the bushing is split longitudinally.

5. A buoyant boom according to claim 2 wherein the bushing comprises UHMW polyethylene.

6. A buoyant boom according to claim 2 wherein the bearing includes an elongate sleeve disposed between the band and the bushing, and a clamp securing the sleeve to the band to prevent relative movement between the sleeve and band.

7. A buoyant boom according to claim 6 wherein the sleeve includes a notched end.

8. A buoyant boom according to claim 6 wherein the sleeve includes a radially extending collar abutting an outer end of the bushing.

9. A buoyant boom according to claim 2 wherein at least one float comprises an elongate tube disposed about the band, and wherein at least one bushing is disposed within the tube.

10. A buoyant boom according to claim 1 wherein at least one float comprises an outer shell with opposing end walls each having an opening through which the band extends.

11. A buoyant boom according to claim 10 wherein the shell is filled with buoyant foam.

12. A buoyant boom according to claim 11 wherein the foam comprises polyurethane foam having a density no greater than 2.5 lbs. per cu. ft.

13. A buoyant boom according to claim 10 wherein the shell and tube are metal.

14. A buoyant boom according to claim 1 wherein the band is selected from components consisting of: metal wire rope; metal chain; metal bar stock; a safety link having tensile capacity less than that of the remainder of the band; a shackle; a wire rope thimble; wire rope clamps; a spelter socket; chain linkage; twisted fiber rope; and braided rope.

15. A buoyant boom according to claim 1 comprising at least one end anchor securing an end of the band to the support.

16. A buoyant boom according to claim 1 comprising at least one intermediate anchor securing a middle portion of the band to the support.

17. A buoyant boom according to claim 16 wherein said intermediate anchor comprises an anchor float.

18. A buoyant boom according to claim 16 wherein said intermediate anchor comprises a metal rod embedded in a grouted hole drilled into said support.

19. A buoyant boom according to claim 18 wherein said intermediate anchor comprises a wire rope with a swaged threaded connector and the metal rod has an outer threaded end secured thereto with a splice connector.

20. A buoyant boom according to claim 19 wherein said swaged threaded connector, and splice connector are embedded in the grouted hole.

21. A buoyant boom according to claim 18 wherein said intermediate anchor comprises a base plate rotatably mounted to an outer end of the metal rod.

* * * * *